US011421922B2

(12) United States Patent
Hahn

(10) Patent No.: US 11,421,922 B2
(45) Date of Patent: Aug. 23, 2022

(54) HEAT DISSIPATION ASSEMBLY FOR A LINEAR COMPRESSOR

(71) Applicant: Haier US Appliance Solutions, Inc., Wilmington, DE (US)

(72) Inventor: Gregory William Hahn, Mt.Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 173 days.

(21) Appl. No.: 16/855,237

(22) Filed: Apr. 22, 2020

(65) Prior Publication Data

US 2021/0333023 A1 Oct. 28, 2021

(51) Int. Cl.

| | |
|---|---|
| ***F25B 31/00*** | (2006.01) |
| ***F04B 39/06*** | (2006.01) |
| ***F04B 39/02*** | (2006.01) |
| ***F04B 35/04*** | (2006.01) |
| ***F25B 31/02*** | (2006.01) |
| ***F25B 1/02*** | (2006.01) |

(52) U.S. Cl.

CPC ..... *F25B 31/006* (2013.01); *F04B 35/045* (2013.01); *F04B 39/0276* (2013.01); *F04B 39/06* (2013.01); *F25B 31/004* (2013.01); *F25B 31/023* (2013.01); *F04B 39/0261* (2013.01); *F25B 1/02* (2013.01)

(58) Field of Classification Search

CPC .... F04B 39/06; F04B 39/023; F04B 39/0261; F04B 39/0276; F04B 35/045; F25B 31/006; F25B 31/004; F25B 31/023; F25B 1/02

See application file for complete search history.

(56) References Cited

U.S. PATENT DOCUMENTS

| | | | | |
|---|---|---|---|---|
| 3,009,072 A * | 11/1961 | Mossay | H02K 9/19 310/57 |
| 4,138,862 A * | 2/1979 | Muller | H02K 9/19 310/54 |
| 5,653,585 A | 8/1997 | Fresco | |
| 5,664,935 A * | 9/1997 | Nishiuchi | F04D 19/046 415/90 |
| 5,839,327 A * | 11/1998 | Gage | F16H 57/0483 74/607 |
| 6,854,955 B2 * | 2/2005 | Shaffer | F04B 39/0261 184/6.16 |

(Continued)

FOREIGN PATENT DOCUMENTS

KR 100480094 B1 6/2005

OTHER PUBLICATIONS

Engineering Toolbox, "Plastic Thermal Conductivity Coefficents", 2016.*

Engineering Toolbox, "Thermal Conductivity of Metals", 2016.*

*Primary Examiner* — Christopher S Bobish

(74) *Attorney, Agent, or Firm* — Dority & Manning, P.A.

(57) ABSTRACT

A linear compressor includes a housing defining a sump for collecting a lubricant and a pump for circulating a flow of lubricant within the housing. A heat dissipation or heat exchange assembly includes a plate mounted on a lower portion of the housing to define one or more fluid passageways between the plate and the housing. Hot oil is collected from the working components of the linear compressor and is passed through the one or more fluid passageways to discharge heat through the housing before the oil is returned to the sump.

20 Claims, 9 Drawing Sheets

(56) References Cited

U.S. PATENT DOCUMENTS

| | | | | |
|---|---|---|---|---|
| 9,239,054 | B2 * | 1/2016 | Ignatiev | F04C 23/008 |
| 9,568,000 | B2 * | 2/2017 | Yamada | F04C 29/026 |
| 10,132,317 | B2 * | 11/2018 | Lynch | F04C 29/026 |
| 10,247,464 | B2 | 4/2019 | Barito | |
| 2006/0257275 | A1 * | 11/2006 | Park | F04B 39/0292 417/417 |
| 2015/0214817 | A1 * | 7/2015 | Kim | H02K 9/19 310/54 |
| 2019/0107312 | A1 | 4/2019 | Kwangwoon | |

* cited by examiner

HEAT DISSIPATION ASSEMBLY FOR A LINEAR COMPRESSOR

FIELD OF THE INVENTION

The present subject matter relates generally to linear compressors, and more particularly, to heat dissipation systems for linear compressors.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein. Recently, certain refrigerator appliances have included linear compressors for compressing refrigerant. Linear compressors generally include a piston and a driving coil. The driving coil generates a force for sliding the piston forward and backward within a chamber. During motion of the piston within the chamber, the piston compresses refrigerant.

An oil or lubricant supply system is typically included within the compressor housing for lubricating the piston to reduce friction losses due to rubbing of the piston against the wall of the chamber, which can negatively affect an efficiency of an associated refrigerator appliance. However, such linear compressors often suffer from performance issues when the oil temperature is high. For example, as oil is heated during operation of the compressor, oil may be atomized or may otherwise splash around which can cause mechanical losses in the springs or reliability issues related to oil droplet entrainment into the suction gas inlet. Certain linear compressors include external heat exchangers that pass hot oil outside of the housing, but these heat exchangers are complex, costly, and are prone to leaks.

Accordingly, a linear compressor with features for improved performance would be desirable. More particularly, a linear compressor with an improved system for dissipating heat from oil would be particularly beneficial.

BRIEF DESCRIPTION OF THE INVENTION

Aspects and advantages of the invention will be set forth in part in the following description, or may be apparent from the description, or may be learned through practice of the invention.

In one exemplary aspect of the present disclosure, a linear compressor defining an axial direction and a vertical direction is provided. The linear compressor includes a housing defining a sump for collecting lubricant, a pump for circulating a flow of lubricant within the housing, the pump comprising a pump inlet positioned within the sump, and a heat dissipation assembly. The heat dissipation assembly includes a plate mounted to an inner surface of the housing and a fluid passageway defined between the plate and the inner surface of the housing, the fluid passageway having a fluid inlet for receiving the flow of lubricant and a fluid outlet for discharging the flow of lubricant back into the sump.

In another exemplary aspect of the present disclosure, a heat dissipation assembly for a linear compressor is provided. The linear compressor includes a housing defining a sump for collecting lubricant. The heat dissipation assembly includes a plate mounted to an inner surface of the housing and a fluid passageway defined between the plate and the inner surface of the housing, the fluid passageway having a fluid inlet for receiving a flow of lubricant and a fluid outlet for discharging the flow of lubricant back into the sump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
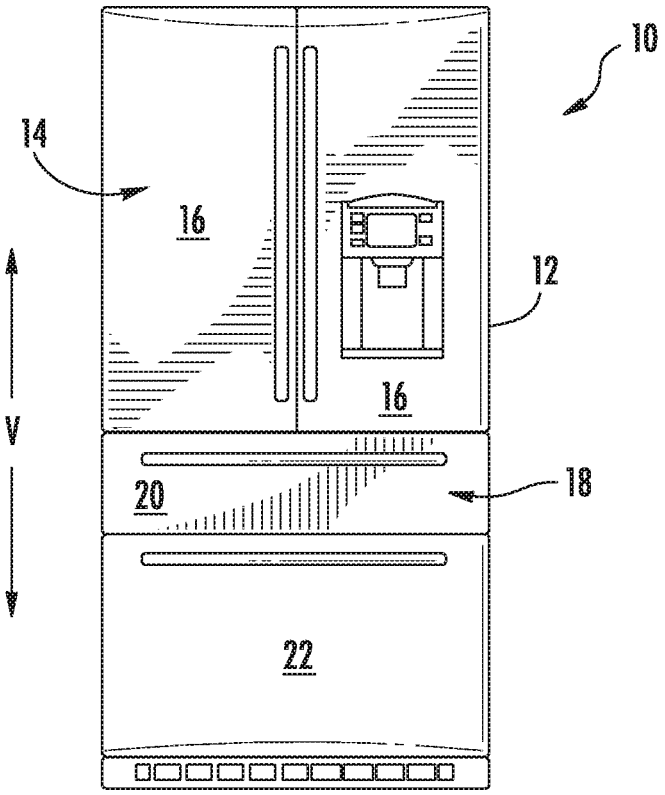
FIG. 1 is a front elevation view of a refrigerator appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
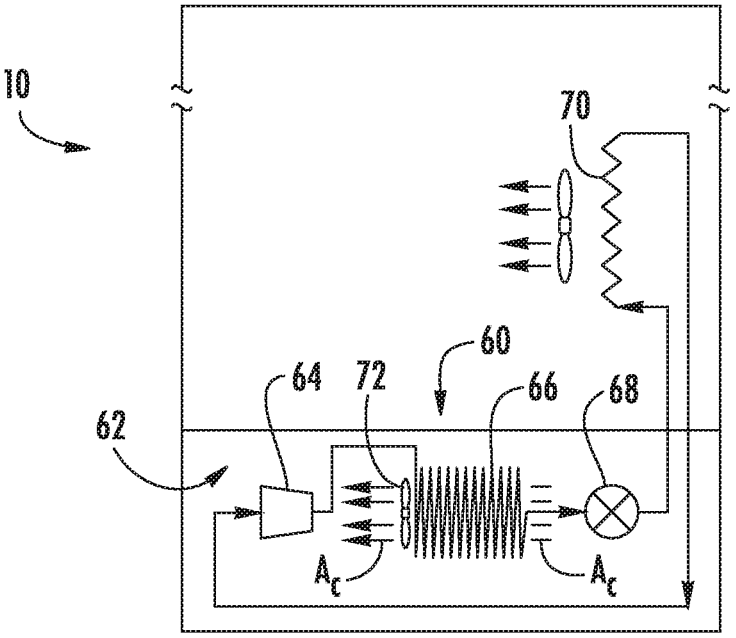
FIG. 2 is schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows Ac, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device 68 (e.g., a valve, capillary tube, or other restriction device) receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
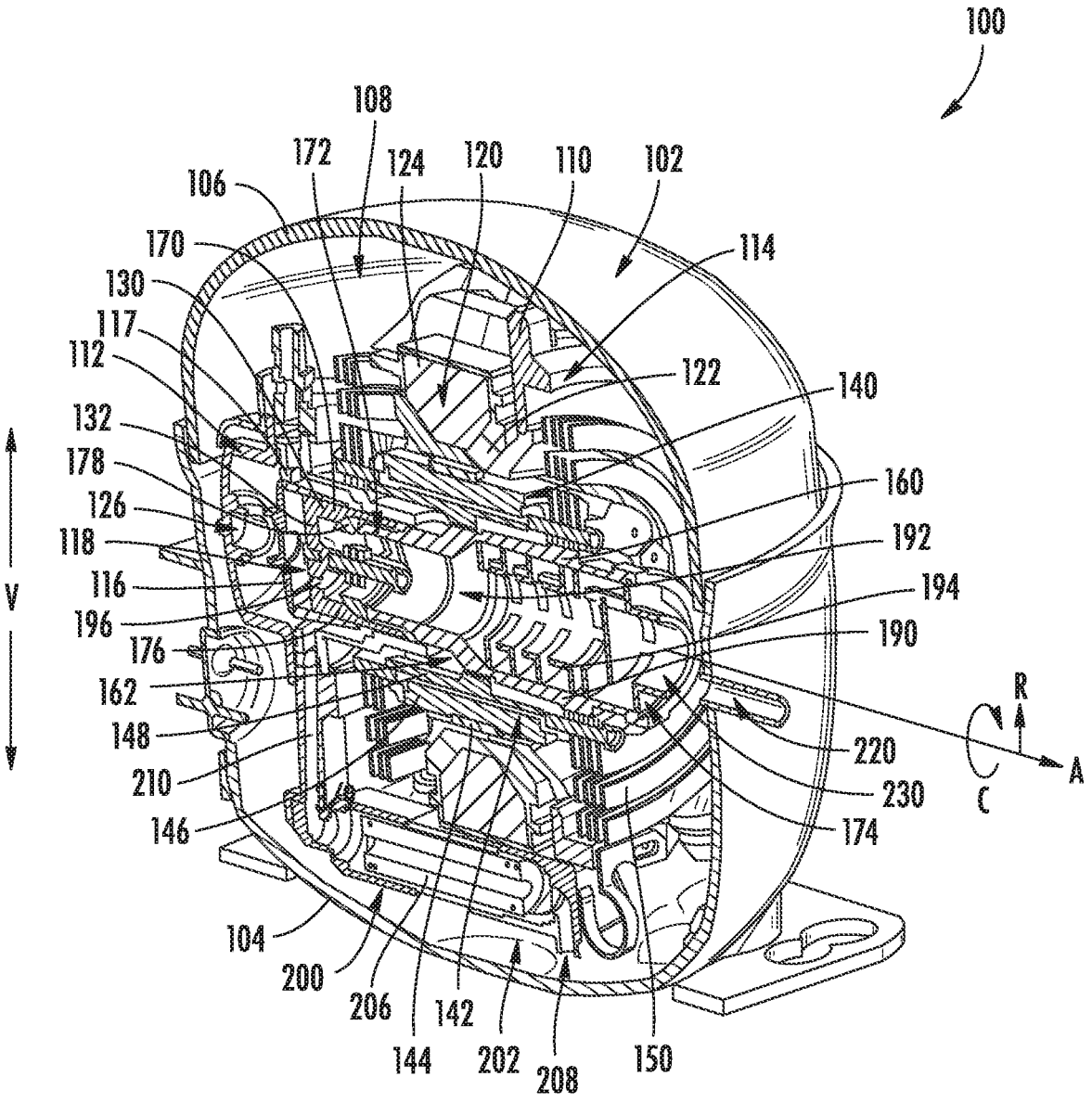
FIG. 3 is a perspective, section view of a linear compressor according to an exemplary embodiment of the present subject matter.
Figure 4:
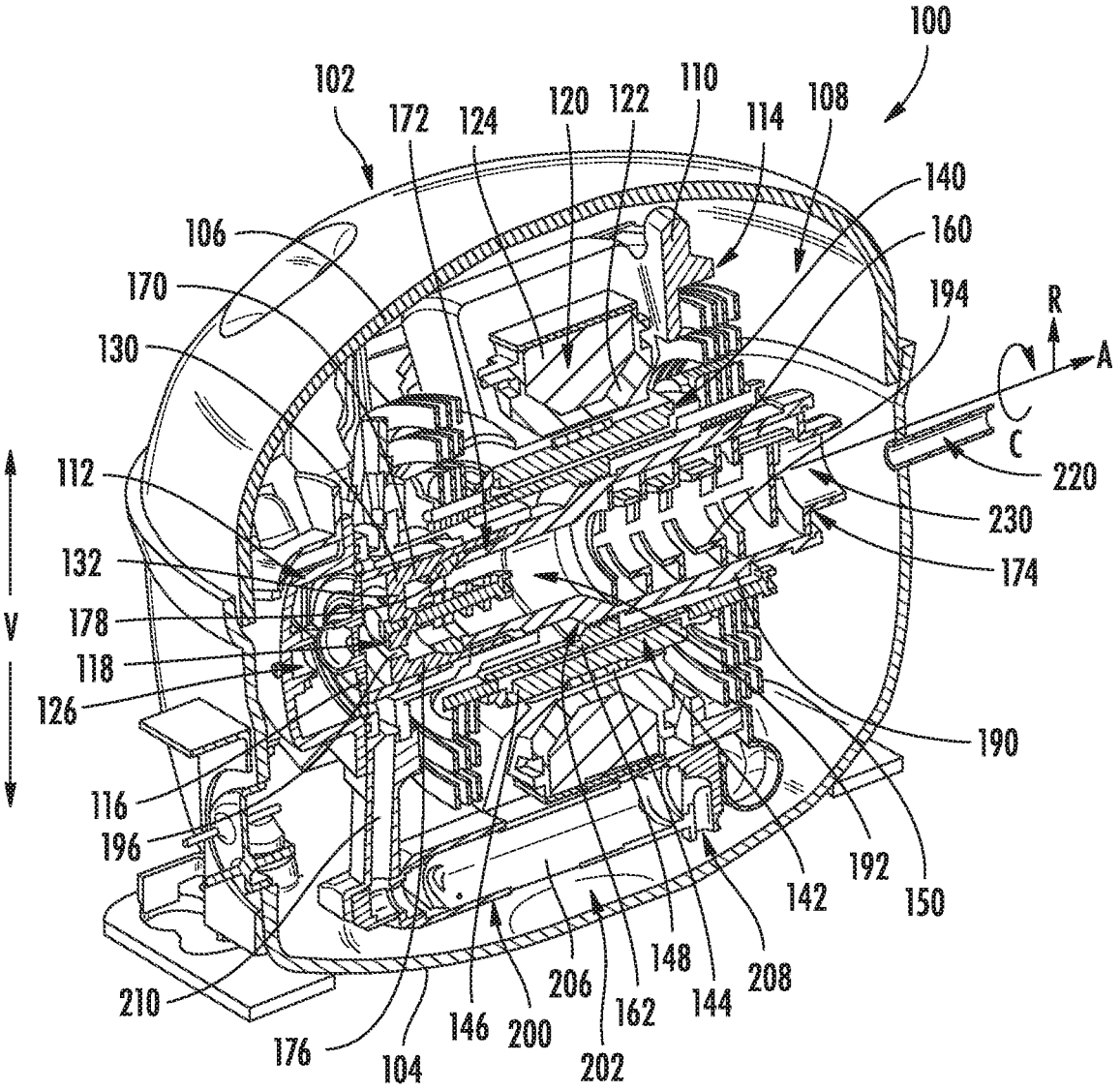
FIG. 4 is another perspective, section view of the exemplary linear compressor of FIG. 3 according to an exemplary embodiment of the present subject matter.
Figure 5:
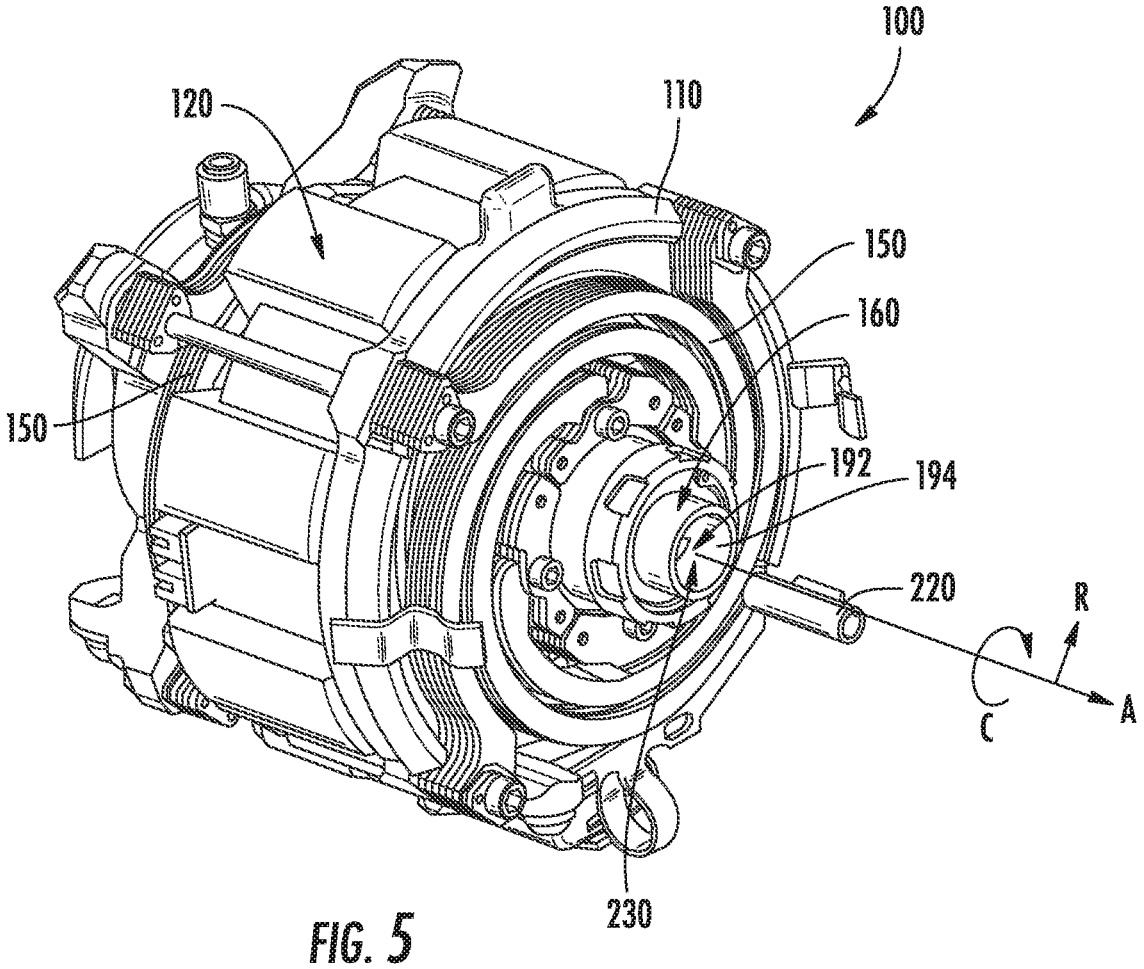
FIG. 5 is a perspective view of a linear compressor with a compressor housing removed for clarity according to an example embodiment of the present subject matter.
Figure 6:
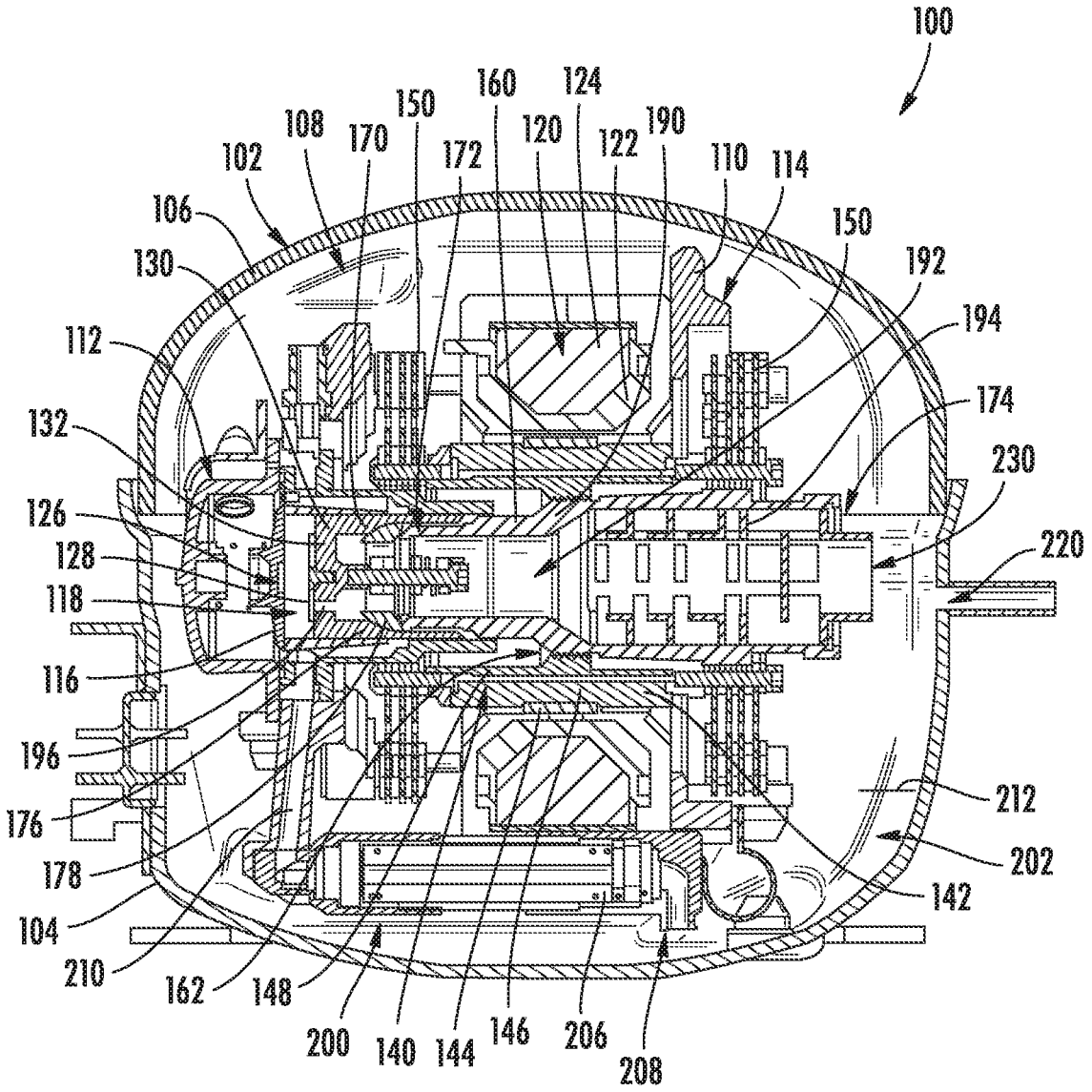
FIG. 6 is a section view of the exemplary linear compressor of FIG. 3 with a piston in an extended position according to an exemplary embodiment of the present subject matter.
Figure 7:
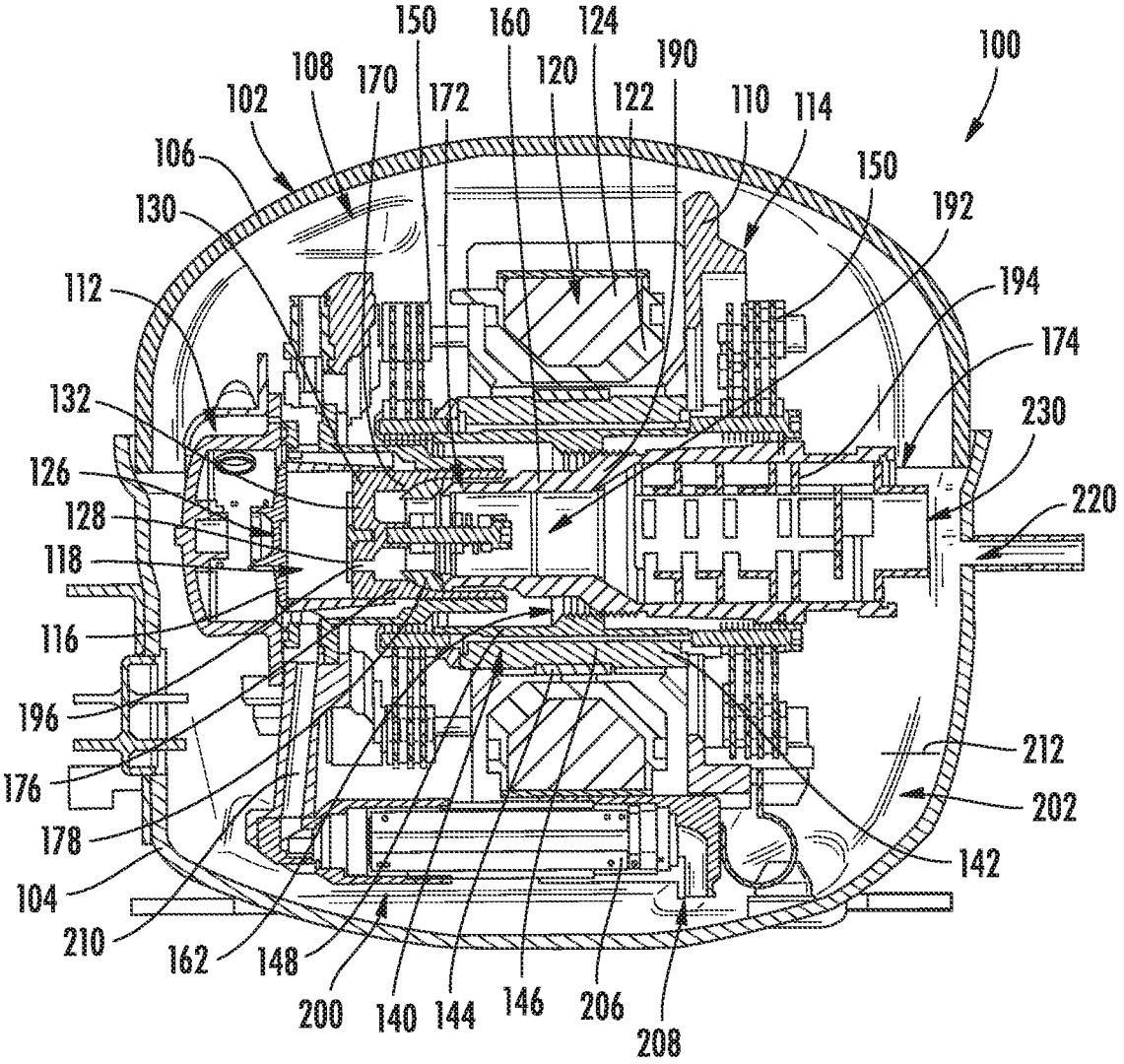
FIG. 7 is a section view of the exemplary linear compressor of FIG. 3 with the piston in a retracted position according to an exemplary embodiment of the present subject matter.

Referring now generally to FIGS. 3 through 7, a linear compressor 100 will be described according to exemplary embodiments of the present subject matter. Specifically, FIGS. 3 and 4 provide perspective, section views of linear compressor 100, FIG. 5 provides a perspective view of linear compressor 100 with a compressor shell or housing 102 removed for clarity, and FIGS. 6 and 7 provide section views of linear compressor when a piston is in an extended and retracted position, respectively. It should be appreciated that linear compressor 100 is used herein only as an exemplary embodiment to facilitate the description of aspects of the present subject matter. Modifications and variations may be made to linear compressor 100 while remaining within the scope of the present subject matter.

As illustrated for example in FIGS. 3 and 4, housing 102 may include a lower portion or lower housing 104 and an upper portion or upper housing 106 which are joined together to form a substantially enclosed cavity 108 for housing various components of linear compressor 100. Specifically, for example, cavity 108 may be a hermetic or air-tight shell that can house working components of linear compressor 100 and may hinder or prevent refrigerant from leaking or escaping from refrigeration system 60. In addition, linear compressor 100 generally defines an axial direction A, a radial direction R, and a circumferential direction C. It should be appreciated that linear compressor 100 is described and illustrated herein only to describe aspects of the present subject matter. Variations and modifications to linear compressor 100 may be made while remaining within the scope of the present subject matter.

Referring now generally to FIGS. 3 through 7, various parts and working components of linear compressor 100 will be described according to an exemplary embodiment. As shown, linear compressor 100 includes a casing 110 that extends between a first end portion 112 and a second end portion 114, e.g., along the axial direction A. Casing 110 includes a cylinder 117 that defines a chamber 118. Cylinder 117 is positioned at or adjacent first end portion 112 of casing 110. Chamber 118 extends longitudinally along the axial direction A. As discussed in greater detail below, linear compressor 100 is operable to increase a pressure of fluid within chamber 118 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2).

Linear compressor 100 includes a stator 120 of a motor that is mounted or secured to casing 110. For example, stator 120 generally includes an outer back iron 122 and a driving coil 124 that extend about the circumferential direction C within casing 110. Linear compressor 100 also includes one or more valves that permit refrigerant to enter and exit chamber 118 during operation of linear compressor 100. For example, a discharge muffler 126 is positioned at an end of chamber 118 for regulating the flow of refrigerant out of chamber 118, while a suction valve 128 (shown only in FIGS. 6-7 for clarity) regulates flow of refrigerant into chamber 118.

A piston 130 with a piston head 132 is slidably received within chamber 118 of cylinder 117. In particular, piston 130 is slidable along the axial direction A. During sliding of piston head 132 within chamber 118, piston head 132 compresses refrigerant within chamber 118. As an example, from a top dead center position (see, e.g., FIG. 6), piston head 132 can slide within chamber 118 towards a bottom dead center position (see, e.g., FIG. 7) along the axial direction A, i.e., an expansion stroke of piston head 132. When piston head 132 reaches the bottom dead center position, piston head 132 changes directions and slides in chamber 118 back towards the top dead center position, i.e., a compression stroke of piston head 132. It should be understood that linear compressor 100 may include an additional piston head and/or additional chambers at an opposite end of linear compressor 100. Thus, linear compressor 100 may have multiple piston heads in alternative exemplary embodiments.

As illustrated, linear compressor 100 also includes a mover 140 which is generally driven by stator 120 for compressing refrigerant. Specifically, for example, mover 140 may include an inner back iron 142 positioned in stator 120 of the motor. In particular, outer back iron 122 and/or driving coil 124 may extend about inner back iron 142, e.g., along the circumferential direction C. Inner back iron 142 also has an outer surface that faces towards outer back iron 122 and/or driving coil 124. At least one driving magnet 144 is mounted to inner back iron 142, e.g., at the outer surface of inner back iron 142.

Driving magnet 144 may face and/or be exposed to driving coil 124. In particular, driving magnet 144 may be spaced apart from driving coil 124, e.g., along the radial direction R by an air gap. Thus, the air gap may be defined between opposing surfaces of driving magnet 144 and driving coil 124. Driving magnet 144 may also be mounted or fixed to inner back iron 142 such that an outer surface of driving magnet 144 is substantially flush with the outer surface of inner back iron 142. Thus, driving magnet 144 may be inset within inner back iron 142. In such a manner, the magnetic field from driving coil 124 may have to pass through only a single air gap between outer back iron 122 and inner back iron 142 during operation of linear compressor 100, and linear compressor 100 may be more efficient relative to linear compressors with air gaps on both sides of a driving magnet.

As may be seen in FIG. 3, driving coil 124 extends about inner back iron 142, e.g., along the circumferential direction C. In alternative example embodiments, inner back iron 142 may extend around driving coil 124 along the circumferential direction C. Driving coil 124 is operable to move the inner back iron 142 along the axial direction A during operation of driving coil 124. As an example, a current may be induced within driving coil 124 by a current source (not shown) to generate a magnetic field that engages driving magnet 144 and urges piston 130 to move along the axial direction A in order to compress refrigerant within chamber 118 as described above and will be understood by those skilled in the art. In particular, the magnetic field of driving coil 124 may engage driving magnet 144 in order to move inner back iron 142 and piston head 132 along the axial direction A during operation of driving coil 124. Thus, driving coil 124 may slide piston 130 between the top dead center position and the bottom dead center position, e.g., by moving inner back iron 142 along the axial direction A, during operation of driving coil 124.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 124 of the motor. Thus, the controller may selectively activate driving coil 124, e.g., by inducing current in driving coil 124, in order to compress refrigerant with piston 130 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Inner back iron 142 further includes an outer cylinder 146 and an inner sleeve 148. Outer cylinder 146 defines the outer surface of inner back iron 142 and also has an inner surface positioned opposite the outer surface of outer cylinder 146. Inner sleeve 148 is positioned on or at inner surface of outer cylinder 146. A first interference fit between outer cylinder 146 and inner sleeve 148 may couple or secure outer cylinder 146 and inner sleeve 148 together. In alternative exemplary embodiments, inner sleeve 148 may be welded, glued, fastened, or connected via any other suitable mechanism or method to outer cylinder 146.

Outer cylinder 146 may be constructed of or with any suitable material. For example, outer cylinder 146 may be constructed of or with a plurality of (e.g., ferromagnetic) laminations. The laminations are distributed along the circumferential direction C in order to form outer cylinder 146 and are mounted to one another or secured together, e.g., with rings pressed onto ends of the laminations. Outer cylinder 146 may define a recess that extends inwardly from the outer surface of outer cylinder 146, e.g., along the radial direction R. Driving magnet 144 is positioned in the recess on outer cylinder 146, e.g., such that driving magnet 144 is inset within outer cylinder 146.

Linear compressor 100 also includes a pair of planar springs 150. Each planar spring 150 may be coupled to a respective end of inner back iron 142, e.g., along the axial direction A. During operation of driving coil 124, planar springs 150 support inner back iron 142. In particular, inner back iron 142 is suspended by planar springs 150 within the stator or the motor of linear compressor 100 such that motion of inner back iron 142 along the radial direction R is hindered or limited while motion along the axial direction A is relatively unimpeded. Thus, planar springs 150 may be substantially stiffer along the radial direction R than along the axial direction A. In such a manner, planar springs 150 can assist with maintaining a uniformity of the air gap between driving magnet 144 and driving coil 124, e.g., along the radial direction R, during operation of the motor and movement of inner back iron 142 on the axial direction A. Planar springs 150 can also assist with hindering side pull forces of the motor from transmitting to piston 130 and being reacted in cylinder 117 as a friction loss.

A flex mount 160 is mounted to and extends through inner back iron 142. In particular, flex mount 160 is mounted to inner back iron 142 via inner sleeve 148. Thus, flex mount 160 may be coupled (e.g., threaded) to inner sleeve 148 at the middle portion of inner sleeve 148 and/or flex mount 160 in order to mount or fix flex mount 160 to inner sleeve 148. Flex mount 160 may assist with forming a coupling 162. Coupling 162 connects inner back iron 142 and piston 130 such that motion of inner back iron 142, e.g., along the axial direction A, is transferred to piston 130.

Coupling 162 may be a compliant coupling that is compliant or flexible along the radial direction R. In particular, coupling 162 may be sufficiently compliant along the radial direction R such that little or no motion of inner back iron 142 along the radial direction R is transferred to piston 130 by coupling 162. In such a manner, side pull forces of the motor are decoupled from piston 130 and/or cylinder 117 and friction between piston 130 and cylinder 117 may be reduced.

As may be seen in the figures, piston head 132 of piston 130 has a piston cylindrical side wall 170. Cylindrical side wall 170 may extend along the axial direction A from piston head 132 towards inner back iron 142. An outer surface of cylindrical side wall 170 may slide on cylinder 117 at chamber 118 and an inner surface of cylindrical side wall 170 may be positioned opposite the outer surface of cylindrical side wall 170. Thus, the outer surface of cylindrical side wall 170 may face away from a center of cylindrical side wall 170 along the radial direction R, and the inner surface of cylindrical side wall 170 may face towards the center of cylindrical side wall 170 along the radial direction R.

Flex mount 160 extends between a first end portion 172 and a second end portion 174, e.g., along the axial direction A. According to an exemplary embodiment, the inner surface of cylindrical side wall 170 defines a ball seat 176 proximate first end portion. In addition, coupling 162 also includes a ball nose 178. Specifically, for example, ball nose 178 is positioned at first end portion 172 of flex mount 160, and ball nose 178 may contact flex mount 160 at first end portion 172 of flex mount 160. In addition, ball nose 178 may contact piston 130 at ball seat 176 of piston 130. In particular, ball nose 178 may rest on ball seat 176 of piston 130 such that ball nose 178 is slidable and/or rotatable on ball seat 176 of piston 130. For example, ball nose 178 may have a frusto-spherical surface positioned against ball seat 176 of piston 130, and ball seat 176 may be shaped complementary to the frusto-spherical surface of ball nose 178. The frusto-spherical surface of ball nose 178 may slide and/or rotate on ball seat 176 of piston 130.

Relative motion between flex mount 160 and piston 130 at the interface between ball nose 178 and ball seat 176 of piston 130 may provide reduced friction between piston 130 and cylinder 117, e.g., compared to a fixed connection between flex mount 160 and piston 130. For example, when an axis on which piston 130 slides within cylinder 117 is angled relative to the axis on which inner back iron 142 reciprocates, the frusto-spherical surface of ball nose 178 may slide on ball seat 176 of piston 130 to reduce friction between piston 130 and cylinder 117 relative to a rigid connection between inner back iron 142 and piston 130.

Flex mount 160 is connected to inner back iron 142 away from first end portion 172 of flex mount 160. For example, flex mount 160 may be connected to inner back iron 142 at second end portion 174 of flex mount 160 or between first and second end portions 172, 174 of flex mount 160. Conversely, flex mount 160 is positioned at or within piston 130 at first end portion 172 of flex mount 160, as discussed in greater detail below.

In addition, flex mount 160 includes a tubular wall 190 between inner back iron 142 and piston 130. A channel 192 within tubular wall 190 is configured for directing compressible fluid, such as refrigerant or air, though flex mount 160 towards piston head 132 and/or into piston 130. Inner back iron 142 may be mounted to flex mount 160 such that inner back iron 142 extends around tubular wall 190, e.g., at the middle portion of flex mount 160 between first and second end portions 172, 174 of flex mount 160. Channel 192 may extend between first and second end portions 172, 174 of flex mount 160 within tubular wall 190 such that the compressible fluid is flowable from first end portion 172 of flex mount 160 to second end portion 174 of flex mount 160 through channel 192. In such a manner, compressible fluid may flow through inner back iron 142 within flex mount 160 during operation of linear compressor 100. A muffler 194 may be positioned within channel 192 within tubular wall 190, e.g., to reduce the noise of compressible fluid flowing through channel 192.

Piston head 132 also defines at least one opening 196. Opening 196 of piston head 132 extends, e.g., along the axial direction A, through piston head 132. Thus, the flow of fluid may pass through piston head 132 via opening 196 of piston head 132 into chamber 118 during operation of linear compressor 100. In such a manner, the flow of fluid (that is compressed by piston head 132 within chamber 118) may flow within channel 192 through flex mount 160 and inner back iron 142 to piston 130 during operation of linear compressor 100. As explained above, suction valve 128 (FIGS. 6-7) may be positioned on piston head 132 to regulate the flow of compressible fluid through opening 196 into chamber 118.

Referring still to FIGS. 3 through 7, and now also referring to FIG. 8, a lubrication system 200 will be described which may be used with linear compressor 100. Specifically, lubrication system 200 is configured for circulating a lubricant, e.g., such as oil, through the working or moving components of linear compressor 100 to reduce friction, improve efficiency, etc. Although lubrication system 200 is described herein with respect to linear compressor 100, it should be appreciated that aspects of lubrication system 200 may apply to any other suitable compressor or machine that requires continuous lubrication.

Figure 8:
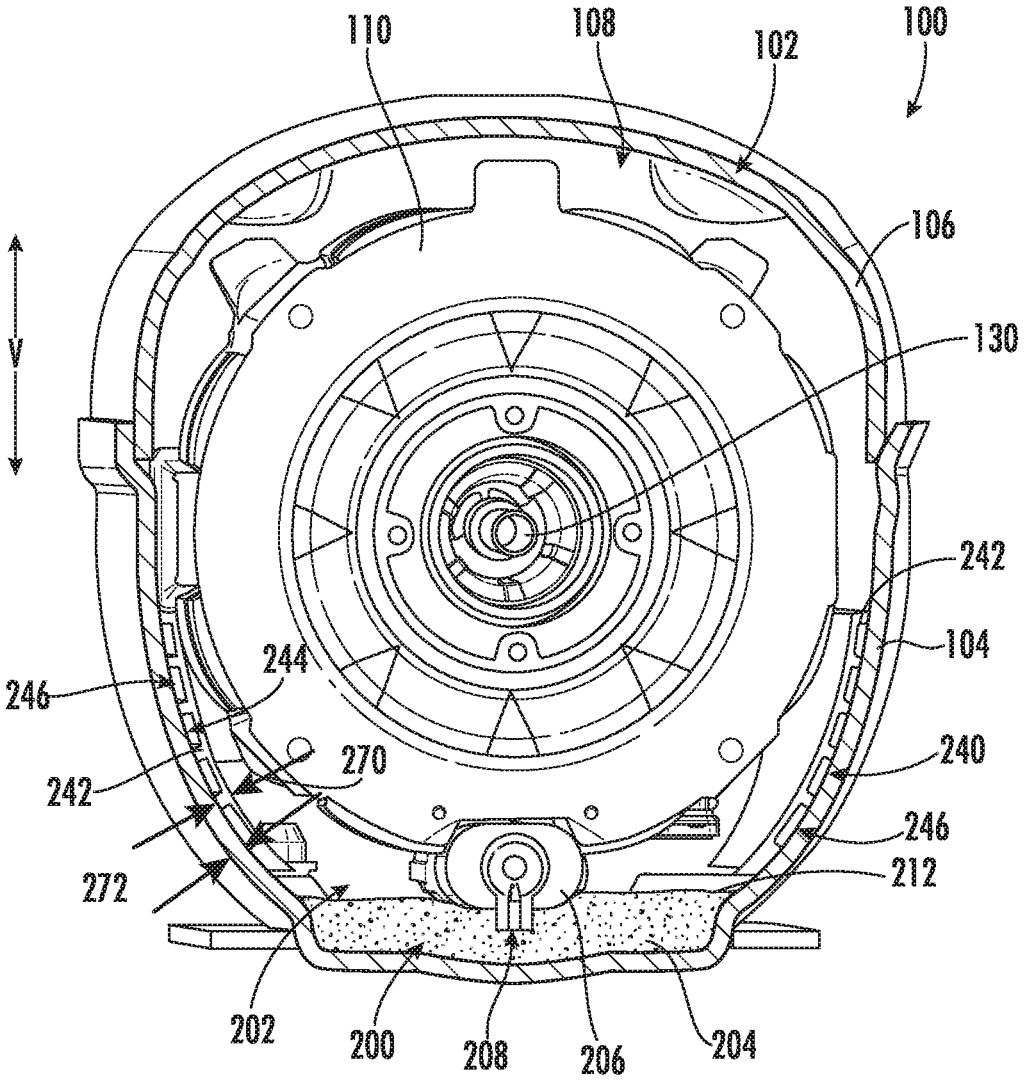
FIG. 8 provides a schematic, cross sectional view of the exemplary linear compressor of FIG. 3 including a heat dissipation assembly according to an exemplary embodiment of the present subject matter.
Figure 9:
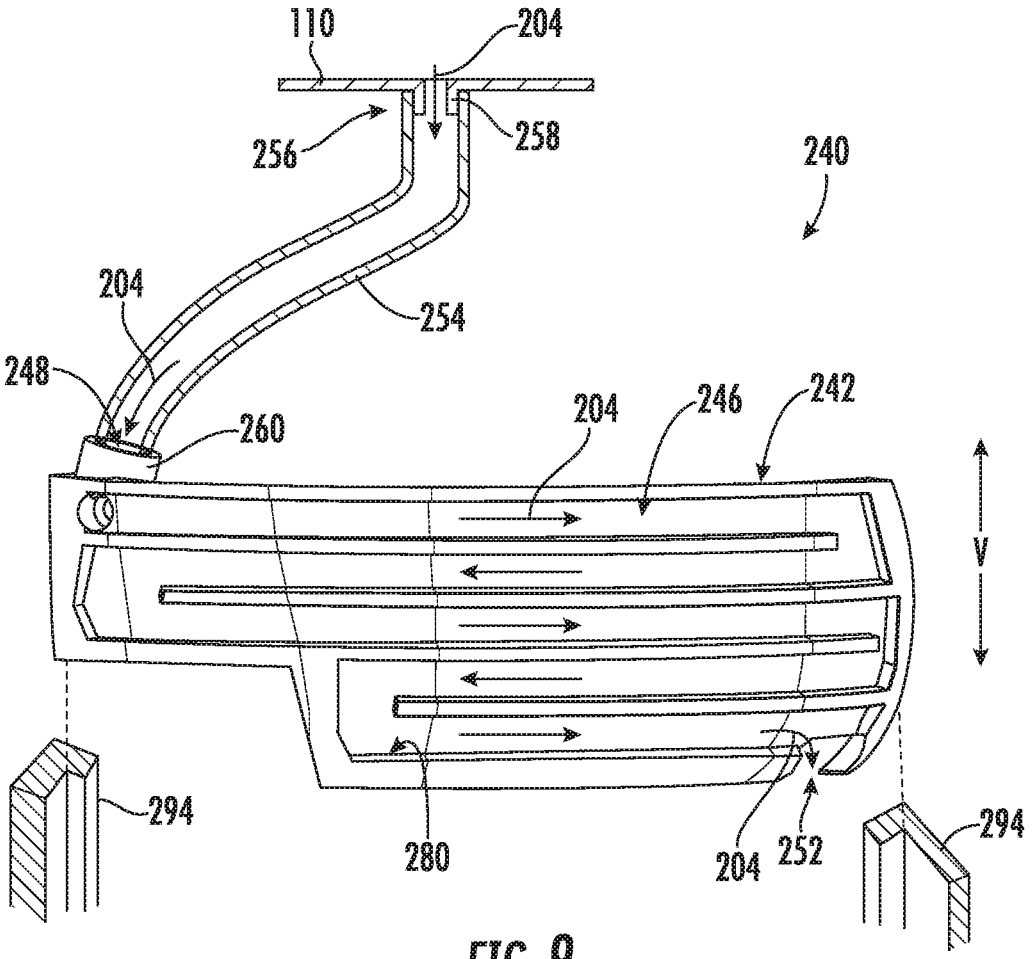
FIG. 9 provides a perspective view of a plate of the exemplary heat dissipation assembly of FIG. 8 according to an exemplary embodiment of the present subject matter.

As shown, housing 102 generally defines a sump 202 which is configured for collecting oil (e.g., as identified herein by reference numeral 204, see FIG. 8). Specifically, sump 202 is defined in the bottom portion of lower housing 104. Lubrication system 200 further includes a pump 206 for continuously circulating oil 204 through components of linear compressor 100 which need lubrication. In this regard, for example, pump 206 may include a pump inlet 208 positioned proximate bottom of housing 102 within sump 202. Pump 206 may draw in oil 204 from sump 202 through pump inlet 208 before circulating it throughout linear compressor 100, e.g., via a supply conduit 210 (FIG. 9). Although only one supply conduit 210 is shown in the figures for clarity, it should be appreciated that lubrication system 200 may include any suitable number of supply conduits, nozzles, and other distribution features in order to provide oil 204 to various components throughout linear compressor 100.

Notably, according to the illustrated embodiment, pump inlet 208 is positioned very near and faces the bottom of lower housing 104. In this manner, pump 206 may readily draw in oil 204 even when oil levels are low. Specifically, linear compressor 100 may be configured for receiving oil 204 not to exceed a max oil fill line 212. For example, the max oil fill line 212 is identified in FIG. 8, and may for example extend less than half the way up lower housing 104, less than a quarter of the way up lower housing 104, or lower. During operation, pump 206 may circulate oil 204 throughout linear compressor 100, after which the oil 204 will seep or flow out of the working components and collect in sump 202 before being recirculated. Although not illustrated here, it should be appreciated that lubrication system 200 may include various features for treating, filtering, or conditioning oil 204 during recirculation, such as various filters, screens, etc. In addition, it should be appreciated that although pump 206 is illustrated as being positioned within sump 202, it could be positioned at any other location and may include a fluid passage that draws oil 204 from sump 202.

As also illustrated in the figures, linear compressor 100 may include a suction inlet 220 for receiving a flow of refrigerant. Specifically, suction inlet 220 may be defined on housing 102 (e.g., such as on lower housing 104), and may be configured for receiving a refrigerant supply conduit to provide refrigerant to cavity 108. As explained above, flex mount 160 includes tubular wall 190, which defines channel 192 for directing compressible fluid, such as refrigerant gas, through flex mount 160 towards piston head 132. In this manner, desirable flow path of refrigerant gas is through suction inlet 220, through channel 192, through opening 196, and into chamber 118. Suction valve 128 may block opening 196 during a compression stroke and a discharge valve 116 may permit the compressed gas to exit chamber 118 when the desired pressure is reached.

Flex mount 160 may further define a channel inlet 230 which is positioned proximate a second end portion 174 of flex mount 160 for drawing gas and from suction inlet 220 or cavity 108 into channel 192. Specifically, channel inlet 230 may be an opening on flex mount 160 which extends substantially within a vertical plane and opens toward suction inlet 220. Specifically, according to the illustrated embodiment, channel inlet 230 and suction inlet 220 may be positioned substantially within the same horizontal plane. According to the illustrated embodiment, suction inlet 220 and channel inlet 230 are also positioned proximate a midpoint of housing 102 along a vertical direction V. However, it should be appreciated that according to alternative embodiments, suction inlet 220 and channel inlet 230 may be positioned at any other suitable locations within housing 102.

Figure 10:
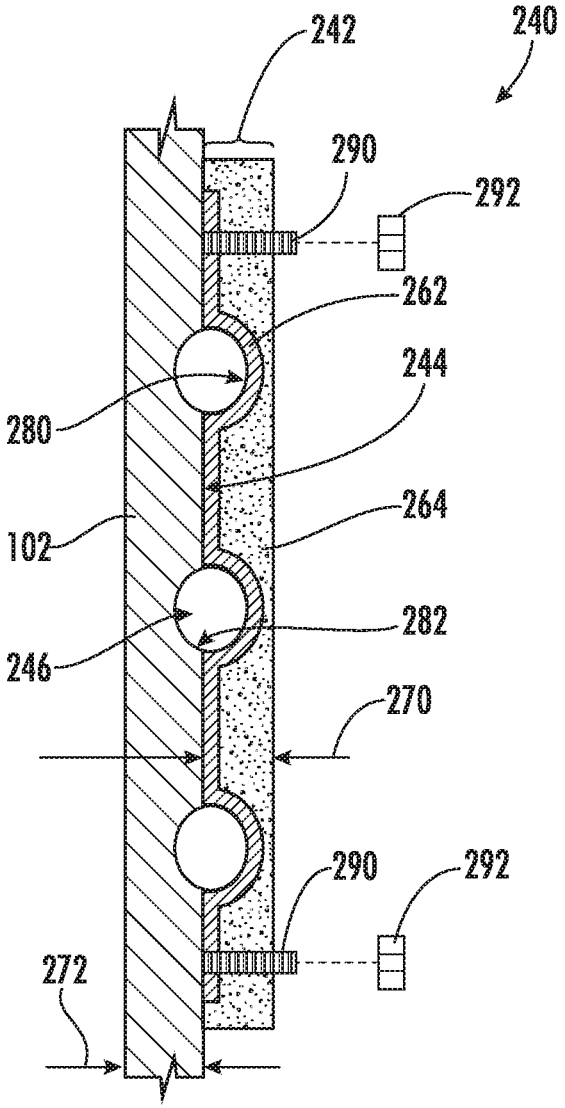
FIG. 10 provides a cross-sectional view of a plate of the exemplary heat dissipation assembly of FIG. 8 mounted to housing according to an exemplary embodiment of the present subject matter.

Referring now specifically to FIGS. 8 through 10, linear compressor 100 may further include features for expelling or dissipating heat that has built up in the oil or lubricant or elsewhere within linear compressor 100. Specifically, according to exemplary embodiments, linear compressor 100 includes a heat dissipation assembly 240 that is positioned within cavity 108 and helps facilitate the discharge of thermal energy from within cavity 108 to outside of housing 102. Although an exemplary heat dissipation assembly 240 is described herein, it should be appreciated that variations and modifications to heat dissipation assembly 240 may be used while remaining within the scope of the present subject matter.

According to the illustrated embodiment, heat dissipation assembly 240 includes a plate 242 that is mounted to an inner surface 244 of housing 102. In general, plate 242 and housing 102 collectively define one or more fluid passageways 246. In this regard, fluid passageways 246 are defined at least in part by and between plate 242 and the inner surface 244 of housing 102. Each fluid passageway 246 may include a fluid inlet 248 for receiving a flow of lubricant (e.g., as identified herein by reference numeral 204) and a fluid outlet 252 for discharging the flow of lubricant 204 back into sump 202. For purposes of explaining aspects of the present subject matter, heat dissipation assembly 240 will be described below as being used with lubrication system 200 of linear compressor 100. However, it should be appreciated that aspects of heat dissipation assembly 240 may be used in other compressors and in other lubrication systems while remaining within the scope of the present subject matter.

In general, heat dissipation assembly 240 discharges or expels heat from lubricant 204 that is absorbed during operation of linear compressor 100. In this regard, for example, hot lubricant 204 may be transferred directly from the moving components of linear compressor 100 to fluid inlet 248. In this regard, heat dissipation assembly 240 may have any suitable mechanism, tubing, or other features for collecting lubricant 204 and directing it into fluid inlet 248. For example, according to one exemplary embodiment, heat dissipation assembly 240 may include a supply tube 254 that provides fluid communication between a hot oil collection point (e.g., identified herein generally by reference numeral 256) and fluid inlet 248. For example, hot oil collection point 256 may be an oil discharge port 258 defined on casing 110 through which the heated lubricant 204 is discharged. In this regard, supply tube 254 may be a flexible tube that connects on one end to an inlet boss 260 of plate 242 which defines fluid inlet 248 and on the other end to oil discharge port 258 or another hot oil collection point 256. According still other embodiments, linear compressor 100 may include a collection tray or trough for collecting lubricant 204 after it has been heated during operation, and such a collection tray may direct the heated lubricant 204 directly into supply tube 254 or fluid inlet 248.

As lubricant 204 passes through fluid passageways 246, thermal energy from the hot lubricant 204 may transfer through housing 102 to the ambient environment. Fluid passageways 246 may have any suitable size, shape, and configuration for maximizing the heat transfer from the heated lubricant 204. For example, according to the illustrated embodiment, flow passageway 246 is serpentine to increase the thermal contact area. According to still other embodiments, fluid passageway 246 may be curvilinear, arcuate, undulating, zigzag, or any other suitable shape. In general, fluid passageways 246 flow downhill such that gravity may help assist the flow of lubricant 204 toward fluid outlet 252. For example, according to the illustrated embodiment, fluid inlet 242 is positioned at a top of plate 242 along the vertical direction V and fluid outlet 252 is positioned at a bottom of plate 242 along the vertical direction V, e.g., proximate a bottom of sump 202. Specifically, according to the illustrated embodiment, fluid outlet 252 is positioned just above Max fill line 212, such that the flow of heated lubricant 204 passes freely through fluid outlet 252 for collecting in sump 202. It should further be appreciated that although a single fluid passageway 246 is illustrated, heat dissipation assembly 240 may include any suitable number of fluid passageways 246.

According to exemplary embodiments, plate 242 may be formed from any material which is sufficiently rigid to maintain fluid passageway 246 and contain a flow of lubricant 204 therein. For example, plate 242 may be formed by injection molding, e.g., using a suitable plastic material, such as injection molding grade Polybutylene Terephthalate (PBT), Nylon 6, high impact polystyrene (HIPS), or acrylonitrile butadiene styrene (ABS). Alternatively, according to the exemplary embodiment, these components may be compression molded, e.g., using sheet molding compound (SMC) thermoset plastic or other thermoplastics. According still other embodiments, plate 242 may be formed from metal or any other suitable rigid material, such as sheet metal.

Notably, according to exemplary embodiments, plate 242 may have a lower thermal conductivity than housing 102. In this manner, plate 242 is generally a thermally insulating material that reduces the amount of heat passing from fluid passageways 246 back into cavity 108. Instead, the heat from lubricant 204 tends to flow directly through housing 102 to the ambient environment. According to still other embodiments, such as that illustrated in FIG. 10, plate 242 may include a thin piece of stamped sheet metal 262 or may otherwise be formed from a relatively thin material. According to an exemplary embodiment, in order to improve the thermal resistance of a plate 242 that includes sheet metal 262, plate 242 may further include an insulative cover 264 that is positioned over the stamped sheet metal plate 262.

In addition, according to exemplary embodiments, plate 242 may define a plate thickness 270 and housing 102 may define a housing thickness 272. According to exemplary embodiments, the plate thickness 270 may be greater than the housing thickness 272, e.g., in order to improve the insulative properties of plate 242 relative to housing 102 and increasing the likelihood that thermal energy is discharged through housing 102. For example, according to an exemplary embodiment, plate thickness 270 is between about 1 and 5 times, between about 2 and 4 times, or about 3 times housing thickness 272. Other suitable plate sizes, shapes, and configurations are possible and within scope of the present subject matter.

According to exemplary embodiments, plate 242 may be curved to match a contour of inner surface 244 of housing 102. In addition, it should be appreciated that heat dissipation assembly 240 may include a plurality of plates 242 positioned at separate locations within housing 102 for dissipating heat at such locations. In addition, the size and position of plates 242 may vary depending on the space constraints within cavity 108. For example, plates 242 may be thicker in regions where space is less restrictive. In addition, according to the illustrated embodiment, plates 242 are mounted on lower housing 104. In this manner, the installation process of supply tube 254 may be simplified. However, other suitable plate positions and configurations are possible and within the scope of the present subject matter.

Notably, fluid passageways 246 may be defined in any manner between housing 102 and plate 242. In this regard, as illustrated for example in FIGS. 8 and 9, plate 242 may define a plate groove 280 that defines fluid passageway 246. By contrast, as shown for example in FIG. 10, housing 102 may also define housing grooves 282 to define a portion of fluid passageways 246. It should be appreciated that grooves 280, 282 may be used together or in the alternative. Indeed, according to other embodiments, fluid passageways may be defined in any other suitable manner.

Plate 242 may be mounted to housing 102 in any suitable manner. For example, according to an exemplary embodiment of the present subject matter, plate 242 may be mounted to housing 202 using one or more mechanical fasteners. In this regard, as illustrated for example in FIG. 10, mechanical fasteners may include one or more studs 290 that are formed as part of housing 102 or are otherwise attached to housing 102. One or more threaded nuts 292 may be configured for engaging stud 290 to secure plate 242 to housing 102. According to still other embodiments, housing 102 may define a plurality of brackets that allow plates 242 to slide securely into fixed position. In this regard, for example, the brackets may be L-shaped brackets 294 (illustrated schematically in FIG. 9) that extend along the vertical direction V and define a groove for receiving plate 242. Other suitable means for mounting plate 242 to housing 102 are possible and within the scope of the present subject matter.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor defining an axial direction and a vertical direction, the linear compressor comprising:
- a housing defining a sump for collecting lubricant;
- a pump for circulating a flow of lubricant within the housing, the pump comprising a pump inlet positioned within the sump; and
- a heat dissipation assembly comprising:
  - a plate mounted to an inner surface of the housing; and
  - a fluid passageway defined between the plate and the inner surface of the housing, the fluid passageway having a fluid inlet for receiving the flow of lubricant and a fluid outlet for discharging the flow of lubricant back into the sump, and wherein the fluid passageway comprises a plurality of horizontal passages and the flow of lubricant is gravity-driven through the plurality of horizontal passages.

2. The linear compressor of claim 1, wherein the heat dissipation assembly further comprises:
- a supply tube providing fluid communication between a hot oil collection point and the fluid inlet of the fluid passageway.

3. The linear compressor of claim 1, wherein the fluid inlet is positioned at a top of the plate along the vertical direction and the fluid outlet is positioned at a bottom of the plate along the vertical direction.

4. The linear compressor of claim 1, wherein the fluid outlet is positioned proximate a bottom of the sump.

5. The linear compressor of claim 1, wherein the fluid passageway is serpentine.

6. The linear compressor of claim 1, wherein the plate defines a plate groove that partially defines the fluid passageway.

7. The linear compressor of claim 1, wherein the housing defines a housing groove that partially defines the fluid passageway.

8. The linear compressor of claim 1, wherein the heat dissipation assembly comprises:
- a plurality of plates mounted to the inner surface of the housing to define a plurality of fluid passageways.

9. The linear compressor of claim 1, wherein the plate is positioned on a lower portion of the housing.

10. The linear compressor of claim 1, wherein the plate is curved to match a contour of the inner surface of the housing.

11. The linear compressor of claim 1, wherein the plate defines a plate thickness and the housing defines a housing thickness, wherein the plate thickness is between 1 and 2 times the housing thickness.

12. The linear compressor of claim 1, wherein the plate is formed from an insulating material.

13. The linear compressor of claim 1, wherein the plate has a lower thermal conductivity than the housing.

14. The linear compressor of claim 1, wherein the plate is formed from a thermoplastic.

15. The linear compressor of claim 1, wherein the plate is formed from stamped sheet metal.

16. The linear compressor of claim 1, wherein the heat dissipation assembly further comprises:

an insulative cover positioned over the plate.

17. The linear compressor of claim 1, further comprising:

a plurality of brackets for fixing the plate against the housing.

18. The linear compressor of claim 1, wherein the plate is mounted to the housing using one or more mechanical fasteners.

19. A heat dissipation assembly for a linear compressor, the linear compressor comprising a housing defining a sump for collecting lubricant, the heat dissipation assembly comprising:

a plate mounted to an inner surface of the housing; and a fluid passageway defined between the plate and the inner surface of the housing, the fluid passageway having a fluid inlet for receiving a flow of lubricant and a fluid outlet for discharging the flow of lubricant back into the sump, wherein the fluid passageway comprises a plurality of horizontal passages and the lubricant is gravity-driven through the plurality of horizontal passages.

20. The heat dissipation assembly of claim 19, wherein the plate is formed from an insulating material having a lower thermal conductivity than the housing.

* * * * *